United States Patent [19]

Thuleen

[11] 4,133,997

[45] Jan. 9, 1979

[54] DUAL FEED, HORIZONTALLY POLARIZED MICROWAVE OVEN

[75] Inventor: Richard A. Thuleen, Minneapolis, Minn.

[73] Assignee: Litton Systems, Inc., Beverly Hills, Calif.

[21] Appl. No.: 766,854

[22] Filed: Feb. 9, 1977

[51] Int. Cl.[2] ..... H05B 9/06

[52] U.S. Cl. ..... 219/10.55 F; 219/10.55 M

[58] Field of Search ..... 219/10.55 F, 10.55 R, 219/10.55 A; 331/5, 90; 333/98 M, 95 S

[56] References Cited

U.S. PATENT DOCUMENTS

| | | | |
|---|---|---|---|
| 2,716,694 | 8/1955 | Schroeder | 219/10.55 F |
| 2,790,054 | 4/1957 | Haagensen | 219/10.55 F |
| 2,909,635 | 10/1959 | Haagensen | 219/10.55 F |
| 3,210,511 | 10/1965 | Smith | 219/10.55 F |
| 3,370,145 | 2/1968 | Malmquist | 219/10.55 F |
| 3,373,259 | 3/1968 | Smith | 219/10.55 F |
| 3,402,277 | 9/1968 | Muller | 219/10.55 F |
| 3,439,143 | 4/1969 | Cougoule | 219/10.55 F |
| 3,462,704 | 8/1969 | Golombek et al. | 219/10.55 R |
| 3,522,550 | 8/1970 | Golombek et al. | 219/10.55 F |
| 3,581,038 | 5/1971 | Williams | 219/10.55 F |
| 3,619,536 | 11/1971 | Boehm | 219/10.55 F |
| 3,965,325 | 6/1976 | Hirai | 219/10.55 F |
| 3,975,606 | 8/1976 | Tanaka et al. | 219/10.55 F |

FOREIGN PATENT DOCUMENTS

| | | | |
|---|---|---|---|
| 1378280 | 10/1964 | France | 219/10.55 F |
| 47-51300 | 1/1972 | Japan | 219/10.55 F |

*Primary Examiner*—J. V. Truhe
*Assistant Examiner*—Bernard Roskoski
*Attorney, Agent, or Firm*—Robert E. Lowe

[57] ABSTRACT

A microwave oven providing for the introduction of microwave energy to a cooking cavity through each of two opposite side walls is disclosed. Each of two side walls includes a window portion and an energy feed box is mounted to each side wall adjacent the window portions. Microwave energy is supplied to the feed boxes through a waveguide from a single microwave source, the waveguide being elongated to provide a lengthy transmission path for the energy believed to produce a long lines effect. The feed system provides enhanced pattern distribution in the cavity and for optimal matching of the waveguide to the cavity with a minimum of tuning.

10 Claims, 5 Drawing Figures

DUAL FEED, HORIZONTALLY POLARIZED MICROWAVE OVEN

BACKGROUND OF THE INVENTION

This invention relates to electronic cooking ovens in general, and more specifically to domestic cooking appliances for cooking foods by the application of energy in the microwave frequency range. The use of such ovens has become increasingly widespread largely due to the speed of cooking offered over conventional techniques.

Microwave ovens have heretofore had some characteristics of cooking performance that were less than satisfactory, expecially in the area of the eveness of the energy pattern throughout the oven capacity and it is well-known that microwave ovens frequently exhibit a pattern of "hot spots" or "cold spots" within the oven.

There are many causes of uneven cooking patterns and performance, and in substantial part of such patterns are determined by the method in which microwave energy is introduced into the cavity. Early ovens provided coaxial antenna projecting through the wall of the oven into the cooking cavity. Other arrangements provided for slotted waveguides which transmitted the energy from the magnetron to the cavity. Still other arrangements coupled the energy into a feed box, or intermediate zone between the waveguide and the cavity and added some type of rotating, energy reflecting device to aid in breaking up standing wave patterns.

It is common practice to use such a stirrer device in the oven cavity itself or in a feed box to change the number of modes present during an interval when food is being heated. A single stationary mode in a microwave oven cavity will exhibit itself as alternate hot spots and cold spots in the heated food. The hot spots are about 2.5 inches apart in an oven operating at 2450 MHZ. The purpose of the stirrer is to attempt to shift the position of the hot spot by changing the phase relationship of the waves that combine to form the single stationary mode.

While these techniques have provided some improvement, ideal performance has not been achieved. Moreover, because of these limitations, microwave ovens have largely been limited to cooking one type of foodstuff at a time.

The invention disclosed herein establishes new techniques for overcoming many of the performance limitations of prior art microwave ovens, especially as those limitations involve eveness of cooking pattern, magnetron to waveguide to cavity impedance matching, power coupling efficiency, and the like. Beneficial use has been made of certain microwave characteristics and techniques which, although known in other fields of microwave technology, are considered undesirable in those fields. One such characteristic which is known in the fields of radar and long distance microwave communications is called the "long lines effect", and equipment used in those fields is generally designed and constructed to eliminate the effect insofar as possible. I have discovered that those same effects can be intentionally designed into microwave ovens to produce suprisingly superior results.

The oven disclosed herein also departs from the conventions of the industry and supplies energy from the magnetron into the cooking cavity through each of two opposite walls, rather than from either the top or bottom of the cavity as is almost universally the case with ovens sold today. As a result, the cavity is horizontally rather than vertically polarized and the interference attributed to the food load in the oven is greatly reduced.

SUMMARY OF THE INVENTION

The present invention provides an oven cavity-waveguide-feed box combination which allows for the introduction of microwave energy to the cavity through each of two opposite side walls. The waveguide is configured to allow for optimal coupling of energy from the magnetron and optimal matching of the waveguide to the cavity with a minimum of tuning adjustments.

In the present invention a box-like oven cavity has a cut-away window portion on each of two opposite side walls. A feed box is mounted to each side wall adjacent the windows, each feed box communicating directly with a waveguide. The waveguide in turn lies along the top surface of the cavity and extends outwardly of one of the feed boxes. A backwall is provided at the end of the outward extension and the magnetron is mounted to allow its antenna to extend into the waveguide in proximity to said back wall. A single tuning stub is also provided in the waveguide.

DESCRIPTION OF PREFERRED EMBODIMENT

Figure 1:
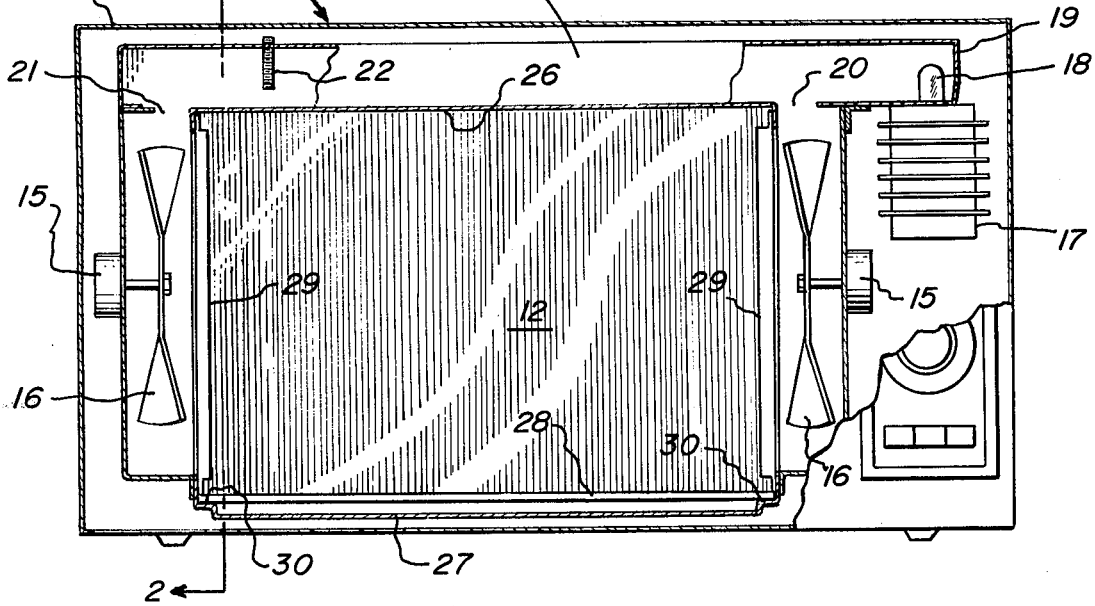
FIG. 1 is a front view in elevation of a microwave oven incorporating the design of the present invention wherein the view has been partly cut away to expose interior components of the oven.
Figure 2:
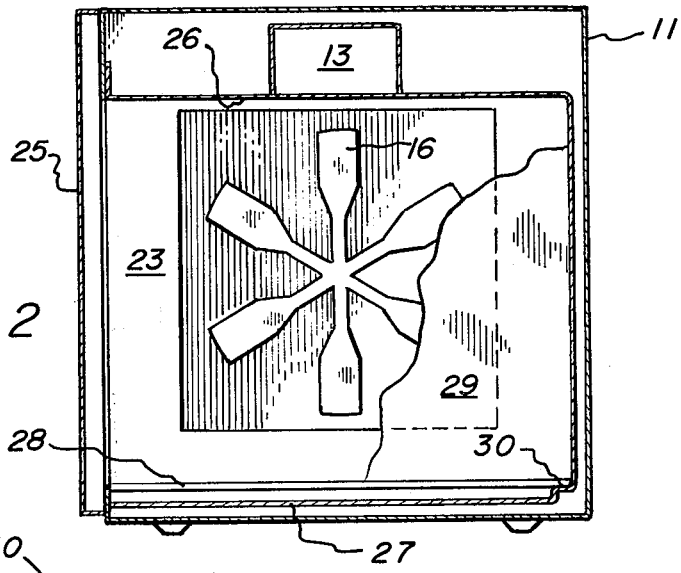
FIG. 2 is a side view of the oven of FIG. 1 in cross-section taken along line 2—2 in FIG. 1.
Figure 3:
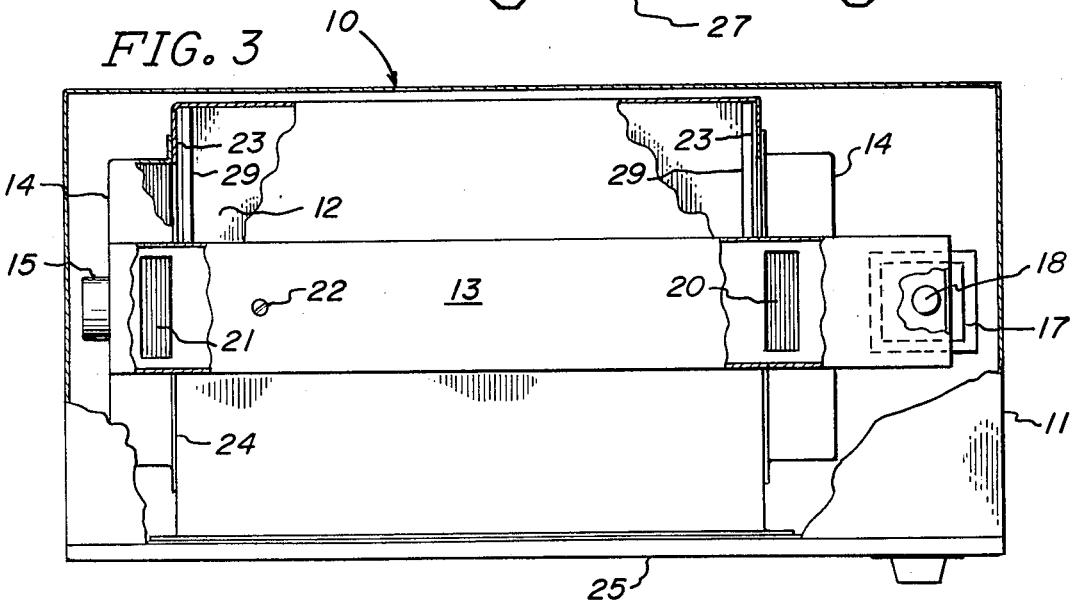
FIG. 3 is a top plan view of the oven of FIG. 1 partially cut away to expose interior elements.

The essential configuration of the oven incorporating the features of the present invention can be readily seen in FIGS. 1–3 in which the numeral 10 denotes the oven generally which includes an outer cabinet or wrap 11, a cooking cavity 12, a waveguide 13 for directing microwave energy into a pair of feed boxes 14 mounted on each side of the cavity 12. A magnetron 17 is mounted to the waveguide 13 having its antenna portion 18 extending into the waveguide in the near vicinity of the back wall 19 of the waveguide.

As the drawings illustrate, the energy emitted by the magnetron 17 travels through waveguide 13 entering the feed boxes 14 through ports 20 and 21. Although port 20 is located relatively near magnetron 17 as in prior art designs, port 21 is spaced a much greater distance away. A major portion of the energy travels through waveguide 13, port 21, feedbox 14 and into cavity 12 wherein some of the energy is transmitted or reflected back to the magnetron along the same lengthy path or through the feed box 14 and port 20 back into the waveguide. In either case, a substantial portion of the energy travels a relatively long path before arriving back to the magnetron 17. This is believed to give rise to a "long lines effect" as described more fully hereinafter.

A stirrer 16 is mounted in each of the feed boxes 14, each stirrer being driven in rotary motion by a motor 15. The stirrers serve to randomly reflect and mix the incoming energy to change the phase relationship of the energy waves to assist in avoiding the formation of a single stationary mode within cavity 12.

Additional ways in which more uniform distribution of microwave energy can be achieved in the cavity include changing the frequency of the incoming microwave energy, changing the phase coherence of the wave, and changing the amplitude of the wave in a random manner. Unfortunately, it has not been heretofore known how to accomplish any or all of these changes in an effective, commercially practical manner. On the other hand, the use of microwave energy in the fields of radar and communications attempts to hold these changes to a minimum. It is believed that the changes may be caused by the so called "long lines effect". In the present invention the long lines effect is purposely enhanced to improve the heating and cooking pattern, and to increase the efficiency of the magnetron.

While it is believed that the improved results observed in the present design are in major part attributable to the beneficial use of the long lines effect, it will be understood that the precise causes of energy distribution patterns are difficult to identify. The invention described and claimed herein should not be viewed as limited to a precise theory of operation although every effort has been made to identify and explain its theory of operation for the benefit of workers in the art.

General discussion of the causes and effects of the long lines effect can be found in the paper "Long-lines Effect and Pulsed Magnetrons" by W. L. Pritchard in the *IRE Transactions on Microwave Theory and Techniques MTT*-4, No. 2, 1956 pp. 97–110. A slightly revised version of the above paper is found in the book *Crossed - Field Microwave Devices,* E. Okness editor, Academic Press, 1961, starting at p. 423.

The long lines effect can occur in a hollow waveguide because it is a dispersive circuit element, which is defined as circuit element in which the phase velocity changes with frequency. For example, in a standard size WR-340 waveguide the phase velocity is such that a waveguide at 2425 MHZ is 17.5113 centimeters while at 2475 MHZ a wavelength is 16.9917 centimeters. Accordingly, for a 360° phase change at 2425 MHZ there is an additional 11.0° change in phase at 2475 MHZ. In a ten wavelength section of guide a reflected wave at 2475 MHZ will be 220.0° out of phase with a wave at 2425 MHZ.

The phase change effect the operation of the magnetron. For example, the efficiency can be calculated as follows:

$$\text{Efficiency} = 1/1 + 0.417\ fo/PQo \quad (1)$$

Where Qo is the unloaded quality factor of the magnetron, P is the pulling figure, and fo is the center frequency of oscillation. The term P or pulling figure is the total excursion of the frequency, f, when the voltage standing wave ratio (VSWR) is equal to 1.5 and is varied through all possible phases. For standing wave ratio of 1.5 about 4 percent of transmitted power is reflected back to the magnetron. With this amount of reflected power the pulling figure is:

$$P = f_2 - f_1 = 0.417\, fo/Q_e \quad (2)$$

Wherein $f_2$ is the maximum frequency, $f_1$, is the minimum, fo is the center frequency as above, and $Q_e$ is the quality factor of the external circuit.

Note in equation (1) that as the product $PQ_o$ becomes larger the efficiency increases, The efficiency is also calculate to be:

$$\text{Efficiency} = 1/1 + Q_e/Q \quad (3)$$

From equation (3) it is seen that when the quality factor of the external circuit is low and the unloaded quality factor is high the efficiency will be high.

The quality factor of a circuit is equal to:

$$Q = 2\pi \times \text{energy stored/energy dissipated per cycle} \quad (4)$$

The energy reflected back to the magnetron can cause the magnetron to start oscillating at another frequency. If the amount of reflected power is high enough, that is the VSWR is high, the magnetron will oscillate at two frequencies at the same time. The spread between the two frequencies is calculated from the equation:

$$\Delta f = \lambda/2\, l\, \lambda g \cdot c \quad (5)$$

Where l is the length of the waveguide, λ is the wave length in free space, λg is the wavelength in the waveguide, and c is the speed of light.

it can be seen that the longer the waveguide the smaller the difference in the two frequencies will be.

Accordingly, it can be seen from the preceding discussion that the pulling figure P is increased by lowering the quality factor $Q_e$ of the external circuit or cavity. A larger pulling figure in turn increases the efficiency and provides for the generation of additional frequencies by the magnetron. The long lines effect is in turn dispersive causing a change in phase relationship between waves of different wavelengths as they arrive back at the magnetron. Moreover, two or more frequencies are generated when the VSWR exceeds about 1.5 because of the long lines effect.

In domestic microwave ovens in use today it is common practice to either introduce the microwave energy directly into the cavity without a waveguide or to use a relatively short section of waveguide extending from one side of the oven to the center of the top or bottom wall. The waveguides in common use are approximately 10 – 20 cm in length. For a standard WR-340 waveguide at 2450 MHZ one wavelength is about 17.3 cm. Thus it can be seen that such waveguides are about one wavelength in length or often somewhat less than one wavelength.

It is also known that the load placed in the oven will effect the output frequency of the magnetron, variations of ± 5 MHZ being common. Applying the equations shown above, it can be calculated that the change in phase between 2445 MHZ and 2455 MHZ, assuming 2450 MHZ as the center frequency, will be about three degrees in one wavelength of waveguide. Accordingly, a reflected wave at 2455 MHZ would arrive back at the magnetron about 6° out of phase with a 2445 MHZ wave. This phase differential is not sufficient to have a significantly measurable impact on the energy dispersion pattern or cooking pattern in the oven.

The oven described herein stands in rather striking contrast. The length of the waveguide 13 from the antenna 18 of the magnetron to the port 21 is about 60 cm or abot 3.4 guide wavelengths in a WR-340 waveguide.

Applying the same equations as in the case of the 15 cm waveguide discussed above, it can be seen that there would exist about a 24° phase difference at the magnetron between a wave at 2445 MHZ and one at 2455 MHZ. In addition, since microwave energy can enter and leave the oven cavity 12 through either of the two feed boxes 14 thereby creating a number of potential paths of travel, and because of the presence of the stirrers 16 in each feed box, it is estimated that at least five to six additional degrees of phase shift may take place.

The large phase shift thus created in the present oven provides favorable conditions for a more dispersed energy patern in the cavity. While the literature dealing with radar applictions suggest that long lines effects appear in waveguides of ten guide wavelengths or more, the present invention indicates that at least in the microwave oven closed circuit environment the long lines effect begins to have impact in a waveguide of at least three guide wavelengths in length.

Figure 4:
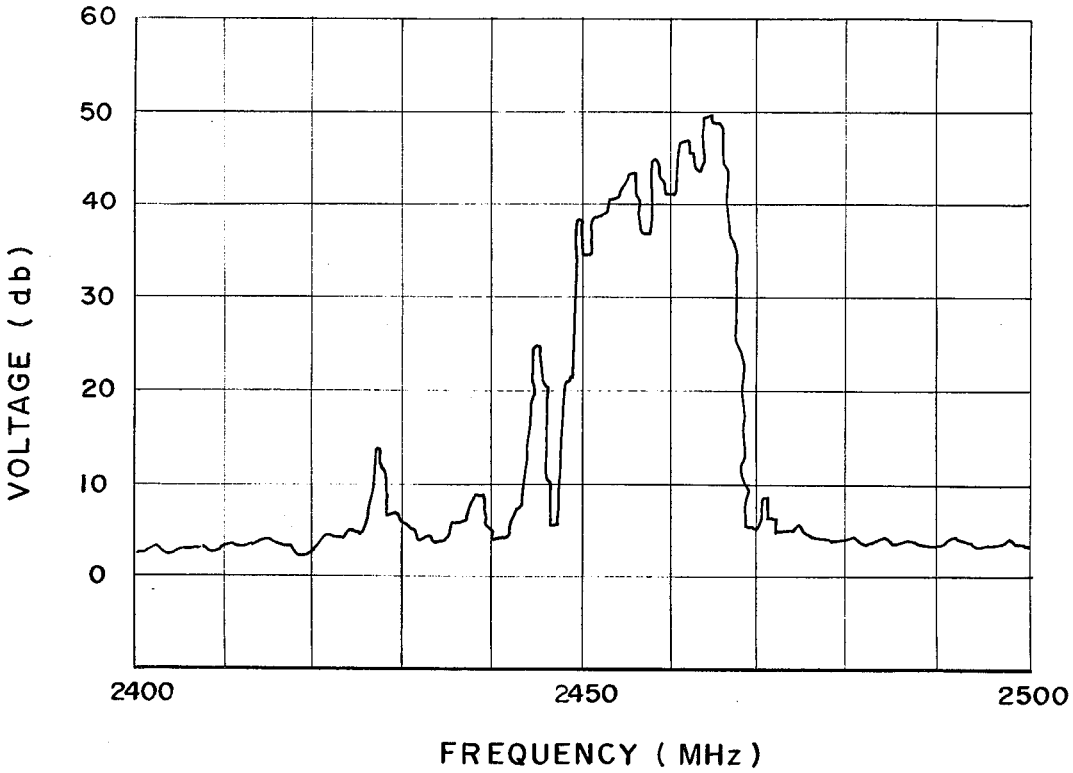
FIG. 4 is an illustration of the display of a spectrum analyzer showing operating characteristics of a prior art oven.
Figure 5:
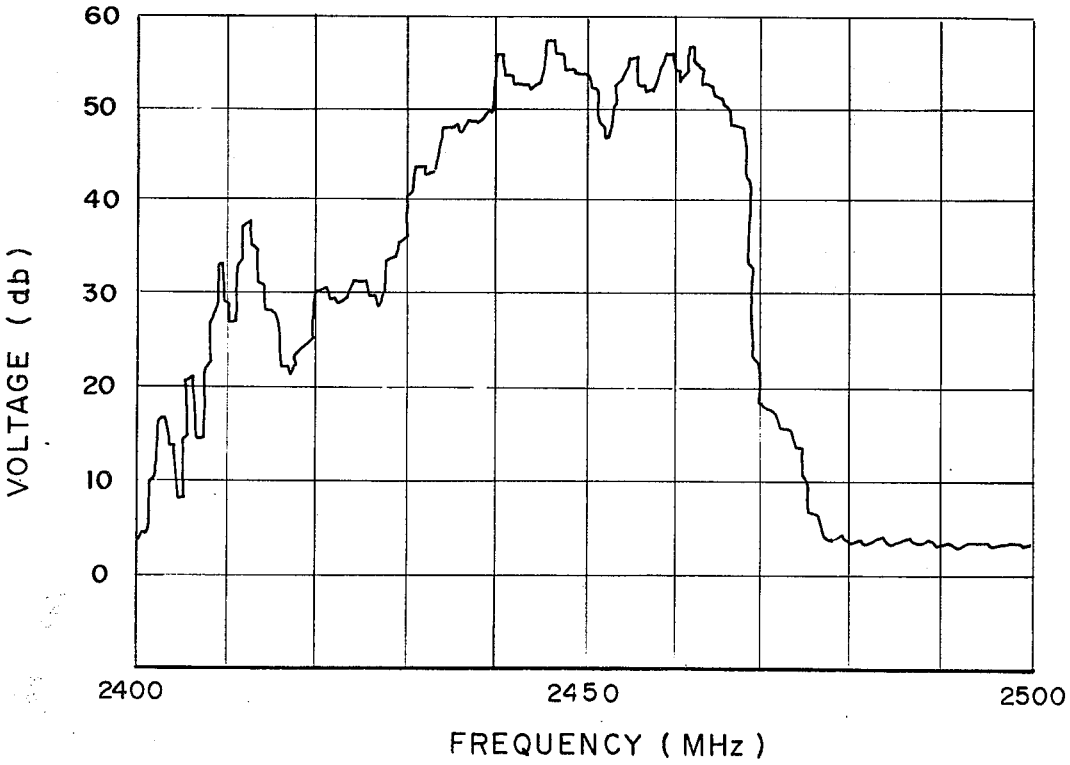
FIG. 5 is an illustration of the display of a spectrum analyzer operating characteristics of the oven incorporating the present invention.

The result of these effects upon the energy effects upon the energy distribution in the cavity is illustrated in FIGS. 4 and 5. Microwave oven energy patterns can be accurately and graphicaly measured using a spectrum analyzer which measures frequency and power and converts it to an oscilloscope display in which frequency is plotted along the abscissa and voltage in decibels along the ordinate. The voltage in decibels is a logarithmic ratio of the measured voltage at each frequency to a preselected base voltage. Polaroid photographs of the scope presentaion were made from which the illustrations in FIGS. 4 and 5 were prepared.

The area of greatest interest from the standpoint of energy distribution pattern and hence cooking pattern is that ying between the 40 db and 50 db lines. The pattern in FIG. 4 was obtained using a Model 415 microwave oven manufactured by Litton Systems, Inc, and having a WR-340 waveguide about 15 cm in length. The pattern shown in FIG. 5 was obtained using an oven as described herein. As can be seen, the pattern in FIG. 4 is largely concentrated in the frequency range from about 2452 MHZ to about 2466 MHZ, with the truly significant concentration in the range of about 2462 to about 2466, a very narrow band. This indicates the existance of a single dominant mode and wave pattern.

On the other hand, the pattern shown in FIG. 5 is spread much more broadly with significant power levels found in the range from about 2430 MHZ to about 2464 MHZ. This indicates multiple significant wave patterns in the oven cavity and hence a much improved cooking pattern as compared with that shown in FIG. 4. The long lines effect has caused a "smearing" of the power across a frequency band, an undesirable result in radar and communications applications, but a result sought after in microwave cooking.

In the structure of the present invention the sidewalls 23 of the cavity 12 each contain a large cut-away portion or window 24. The feed boxes 14 are attached to the exterior surface of the side walls to coincide with the windows 24. Each window is preferably covered with a microwave transparent cover 29.

The bottom wall 27 of the cavity 12 is formed to provide a ledge 30 on which shelf 28 is supported. The shelf 28 is proferably made from a glass or ceramic material which is transparent to microwve energy. Since energy enters the cavity through the side walls 23 rather than through the top, the top wall 26 is substantially flat and solid. The oven is of course provided with a door 25 which can be closed over the front of the cavity during cooking.

In order to effectively couple the output power of the magnetron 17 to the cavity 12 through the waveguide 13 it is necessary to match the waveguide impedance to the impedance of the cavity. While this can be done to some extent through design dimensions other measures are necessary to accomplish "fine tuning". Stub 22 is provided for this purpose, extending into the waveguide at a preselected point. Again using the spectrum analyzer, the optimum position for the stub 22 and its length can be determined. The present design allows the tuning operation to be carried out with a single stub even though energy is fed into the cavity from two feed boxes. In prior art designs each feed entrance has generally required a separate tuning stub.

The oven illustrated herein has been configured for operation at 2450 MHZ although the same principles apply to ovens sized for operation at a different authorized frequency. For optimum operation, the waveguie 13 is approximately 25.5 inches in length with the center line of the magnetron spaced approximately 0.7 inches from the back wall 19 of the waveguide. The stub 22 is preferably located approximately 20.875 inches from the wave guide back wall 19. The waveguide 13 in cross-section is approximately 1.7 inches high and 3.4 inches wide. It is preferred to form the cavity 12, the feed boxes 14 and the waveguide 13 into a unitary welded subassembly to which the remaining operating components may be added, and the entire structure housed within cabinet 11. It is further preferred to have ledge 30 from about 0.5 to 0.75 inches above bottom wall 27 in order to locate flat or low profile food items, such as bacon strips, within an area of high energy field strength.

While in the foregoing specification the invention has been described in great detail, it will be understood that such detail is intended to be illustrative and that modifications can be made by those skilled in the art without departing from the scope of the invention as defined in the appended claims.

I claim:

1. In a microwave oven for cooking foodstuffs, the oven including a cabinet, a cooking cavity and a microwave energy generator the improvement comprising an elongate waveguide having an end wall, antenna means for introducing the microwave energy output of said generator into said waveguide adjacent said end wal, said waveguide including a plurality of exit ports communicating with energy mixing means, said energy mixing means in turn communicating with said cooking cavity whereby at least a portion of said energy travels an unreflected path having a length equal to at least three guide wavelengths from said antenna means to said cavity.

2. A microwave oven including a cooking cavity comprising a rectangular parallelepiped having means communicting with each of two opposing side walls for the passage of microwave energy into said cavity, microwave energy generating means, waveguides for conducting said energy from said generating means to said passage means through an unreflected distance greater than three wavelengths of said energy in said waveguide.

3. A microwave oven for cooking foodstuffs including a cooking chamber, generating means providing microwave energy to said chamber, waveguide means for conducting said energy and having a plurality of energy exit ports wherein the output of said generating means is introduced into said waveguide at a point at least two guide wavelengths from at least one of said exit ports.

4. An oven according to claim 3 having energy receiving means communicating with each of two opposite side walls of said cooking chamber, said exit ports communicating with said energy receiving means.

5. The oven according to claim 3 including energy stirrer means positioned in the energy path between said generating means and said cooking chamber, said stirrer means being rotated within said energy path.

6. The oven according to claim 4 wherein said energy receiving means comprise an energy reflective compartment mounted adjacent each of said opposite side walls adapted to receive energy from said waveguide means through said exit ports.

7. The oven according to claim 6 including energy stirrer means rotatably mounted in said compartments.

8. A method for improving the energy distribution pattern in a microwave oven cooking cavity comprising the steps of:

(a) providing an energy entrance in each of two opposite cavity side walls;

(b) providing an energy mixing chamber in energy transmitting communication with each of said energy entrances;

(c) transmitting microwave energy through a waveguide to said energy mixing chambers and into said cavity through a distance sufficient to create a long lines effect.

9. The method of claim 8 wherein said distance is at least three guide wavelengths.

10. In a microwave oven of the type comprising a generally box-like cooking cavity having top, bottom, back and side walls; a front portion having an access opening and a door closeable thereover; a waveguide extending entirely across said top wall and having at least a portion extending outwardly from said top wall and a microwave energy generating source, the improvement comprising:

a microwave energy feed box mounted to the exterior of each of said side walls, each of said feed boxes being in energy transmitting communication with said waveguie and with the interior of said cooking cavity, said microwave energy generaging source being coupled to said waveguide at said outwardly extending portion whereby said energy is transmitted along said waveguide, into said feed boxes and thence into said cooking cavity, said waveguide and said feed boxes being dimensioned so at least a portion of said energy travels a distance of at least three guide wavelengths from said energy generating source to said cooking cavity along an unreflected path.

* * * * *